US009291051B2

(12) United States Patent
Hester et al.

(10) Patent No.: US 9,291,051 B2
(45) Date of Patent: Mar. 22, 2016

(54) RESERVOIR PRESSURE TESTING TO DETERMINE HYDRATE COMPOSITION

(75) Inventors: Keith C. Hester, Tulsa, OK (US); James J. Howard, Tulsa, OK (US)

(73) Assignee: ConocoPhillips Company, Houston, TX (US)

( * ) Notice: Subject to any disclaimer, the term of this patent is extended or adjusted under 35 U.S.C. 154(b) by 1055 days.

(21) Appl. No.: 13/277,532

(22) Filed: Oct. 20, 2011

(65) Prior Publication Data

US 2012/0103599 A1 May 3, 2012

Related U.S. Application Data

(60) Provisional application No. 61/407,715, filed on Oct. 28, 2010.

(51) Int. Cl.
*E21B 49/00* (2006.01)
*E21B 43/01* (2006.01)

(52) U.S. Cl.
CPC ..... *E21B 49/008* (2013.01); *E21B 2043/0115* (2013.01)

(58) Field of Classification Search
CPC ..... E21B 2043/0115; E21B 49/008
See application file for complete search history.

(56) References Cited

U.S. PATENT DOCUMENTS

| | | | | |
|---|---|---|---|---|
| 3,811,321 | A | 5/1974 | Urbanosky | |
| 4,007,787 | A | 2/1977 | Cottle | |
| 4,745,802 | A | 5/1988 | Purfurst | |
| 4,803,483 | A | 2/1989 | Vandervier et al. | |
| 5,261,490 | A | 11/1993 | Ebinuma | |
| 5,713,416 | A | 2/1998 | Chatterji et al. | |
| 5,741,758 | A * | 4/1998 | Pakulski | 507/90 |
| 6,733,573 | B2 | 5/2004 | Lyon | |
| 6,946,017 | B2 | 9/2005 | Leppin et al. | |
| 7,093,655 | B2 | 8/2006 | Atkinson | |
| 7,165,621 | B2 * | 1/2007 | Ayoub et al. | 166/369 |
| 7,222,673 | B2 | 5/2007 | Graue et al. | |
| 7,530,392 | B2 | 5/2009 | Sugiyama et al. | |
| 7,597,148 | B2 | 10/2009 | O'Malley et al. | |
| 7,638,465 | B2 | 12/2009 | Rivers et al. | |
| 8,590,619 | B2 * | 11/2013 | Wallmann et al. | 166/302 |
| 2003/0178195 | A1 | 9/2003 | Agee et al. | |
| 2004/0168811 | A1 * | 9/2004 | Shaw et al. | 166/368 |
| 2004/0200618 | A1 | 10/2004 | Piekenbrock | |
| 2005/0120878 | A1 | 6/2005 | Leppin et al. | |
| 2005/0121200 | A1 | 6/2005 | Sivaraman | |
| 2006/0032637 | A1 * | 2/2006 | Ayoub et al. | 166/369 |
| 2006/0060356 | A1 * | 3/2006 | Graue et al. | 166/305.1 |
| 2007/0265782 | A1 | 11/2007 | Kleinberg et al. | |
| 2008/0072495 | A1 | 3/2008 | Waycuilis | |
| 2008/0221373 | A1 | 9/2008 | Conant | |
| 2008/0293597 | A1 * | 11/2008 | Rivers | 507/240 |
| 2009/0032248 | A1 * | 2/2009 | Svoboda et al. | 166/249 |
| 2009/0236144 | A1 | 9/2009 | Todd et al. | |
| 2011/0029273 | A1 * | 2/2011 | Lovell | 702/130 |
| 2012/0012321 | A1 * | 1/2012 | Wallmann et al. | 166/305.1 |
| 2012/0222870 | A1 * | 9/2012 | Schaef et al. | 166/402 |

FOREIGN PATENT DOCUMENTS

| | | |
|---|---|---|
| JP | 6071161 | 3/1994 |

OTHER PUBLICATIONS

Rehder, et al., "Dissolution rates of pure methane hydrate and carbon-dioxide hydrate in undersaturated seawater at 1000-m depth," Geochimica et Cosmochimica Acta, 68(2), p. 285-292 (2004).

Nakano, et al.,"Natural Gas Exploitation by Carbon Dioxide from Gas Hydrate Fields—High-Pressure Phase Equilibrium for an Ethane Hydrate System." Proceedings of the Institution of Mechanical Engineers 212:159-163 (1998).

Hornbach, et al., "Direct seismic detection of methane hydrate on the Blake Ridge, Geophysics," 68: (2003).

Liu and Flemings, "Dynamic multiphase flow model of hydrate formation in marine sediments," J. Geophys. Res., 112: B03101, doi:10.1029/2005JB004227, (2007).

Uchida, et al., "Replacing Methane with CO2 in Clathrate Hydrate: Observations Using Raman Spectroscopy." In Proceedings of the Fifth International Conference on Greenhouse Gas Control Technologies (ed. D. J. Williams, et al.), pp. 523-527. CSIRO Publishing, Collingwood, Australia (2001).

Lee, et al., "Recovering Methane from Solid Methane Hydrate with Carbon Dioxide." Angewandte Chemie-International Edition 42:5048-5051 (2003).

McGrail, et al., "A New Method for Enhanced Production of Gas Hydrates with CO2" Gas Hydrates: Energy Resource Potential and Associated Geologic Hazards, American Association of Petroleum Geologists (2004).

Legg & Campbell, "Carbon Dioxide Capture and Storage: A Compendium of Canada's Participation", Office of Energy Research and Development, Natural Resources Canada (2006).

Energy Policy Act of 2005 • Section 353(e) "Gas Hydrate Production Incentive—Review," U.S. Department of the Interior, Mineral Management Services, (Aug. 2006).

Goel, N., "In Situ Methane Hydrate Dissociation with Carbon Dioxide Sequestration: Current Knowledge and Issues." J. Pet. Sci. Eng. 51:169-184 (2006).

(Continued)

*Primary Examiner* — John Fitzgerald
(74) *Attorney, Agent, or Firm* — ConocoPhillips Company

(57) ABSTRACT

The present invention relates to a method and system for identifying one or more characteristics within a subterranean reservoir of natural gas.

9 Claims, No Drawings

(56) References Cited

OTHER PUBLICATIONS

J-C. Iseux, "Gas Hydrates: Occurrence, Production and Economics," SPE Paper No. 21682, prepared for presentation at the Production Operations Symposium held in Oklahoma City, Oklahoma, Apr. 7-9, 1991.

PCT/US11/57062 PCT International Search Report (PCT/ISA/210) Dated Oct. 1, 2012.

* cited by examiner

RESERVOIR PRESSURE TESTING TO DETERMINE HYDRATE COMPOSITION

CROSS-REFERENCE TO RELATED APPLICATIONS

This application claims priority benefit under 35 U.S.C. Section 119(e) to U.S. Provisional Patent Ser. No. 61/407,715 filed on Oct. 28, 2010 the entire disclosure of which is incorporated herein by reference.

FIELD OF THE INVENTION

The present invention relates to a method and system for identifying one or more characteristics within a subterranean reservoir of natural gas.

BACKGROUND OF THE INVENTION

A number of hydrocarbons, especially lower boiling-point light hydrocarbons, in porous media or natural gas fluids, are known to form hydrates in conjunction with the water present under a variety of conditions—particularly at a combination of lower temperature and higher pressure. The hydrates are solid crystalline compounds which co-exist with the surrounding porous media or natural gas fluids. Any solids in produced fluids are at least a nuisance for production, handling, and transport of these fluids. It is not uncommon for solid hydrates to cause plugging and/or blockage of pipelines or transfer lines or other conduits, valves and/or safety devices and/or other equipment, resulting in shutdown, loss of production, and risk of explosion or unintended release of hydrocarbons into the environment either on-land or offshore. Accordingly, hydrocarbon hydrates have been of substantial interest as well as concern to many industries, particularly the petroleum and natural gas industries.

Natural gas hydrates are in a class of compounds known as clathrates, and are also referred to as inclusion compounds. Clathrates consist of cage structures formed between a host molecule and a guest molecule. Gas hydrates are generally composed of crystals formed by water host molecules surrounding the hydrocarbon guest molecules. The smaller or lower-boiling hydrocarbon molecules, particularly $C_1$ (methane) to $C_4$ hydrocarbons and their mixtures, are often the most problematic in the oil and gas industry because they form in hydrate or clathrate crystals under a wide range of production conditions. Even certain non-hydrocarbons such as carbon dioxide and hydrogen sulfide are known to form hydrates under the proper conditions. Beyond being a problem for production of hydrocarbons, hydrates are being looked at as a possible energy source.

At this time the only know method for determining the composition of a hydrate found in a subterranean reservoir is to monitor the composition of gases released by the dissociation of the hydrate. This is accomplished either by sampling a hydrate-bearing core that was brought to the surface, or by collected gases in the subterranean reservoir. Preservation of hydrate-bearing cores as they are brought to the surface in coring devices is problematic as the surrounding temperatures and pressures fall outside the thermodynamic stability zones. While some hydrate remains in the core there is concern that it does not represent the composition of the original. The collection of gas samples in a borehole with the intent of bringing the sample to the surface for analysis is also difficult, especially in obtaining an uncontaminated sample. Therefore, a need exists for identifying one or more characteristics, including the composition of the actual hydrate, within the subterranean reservoir.

SUMMARY OF THE INVENTION

In an embodiment, a method for determining one or more characteristics of a subterranean reservoir includes: (a) injecting a releasing agent into the subterranean reservoir; (b) determining an initial pressure within a subterranean reservoir; (c) reducing the pressure within the subterranean reservoir; and (d) stabilizing the pressure in the subterranean reservoir, wherein steps (c)-(d) are repeated.

In another embodiment, a method for determining one or more characteristics of a subterranean reservoir includes: (a) inserting a formation testing tool into the subterranean reservoir; (b) allowing the formation testing tool to equilibrate with the subterranean reservoir; (c) injecting a releasing agent into the subterranean reservoir; (d) determining an initial pressure reduction within a subterranean reservoir, wherein the initial pressure is greater than a stability value; (e) reducing the pressure within the subterranean reservoir, wherein the pressure is incrementally reduced; and (f) stabilizing the pressure in the subterranean reservoir, wherein steps (e)-(f) are repeated.

In yet another embodiment, a method for determining one of more characteristics of a subterranean reservoir, includes: (a) installing a formation testing tool into the subterranean reservoir; (b) allowing the formation testing tool to equilibrate with the subterranean reservoir; (c) injecting a releasing agent into the subterranean reservoir, wherein the releasing agent reduces the pressure within the subterranean reservoir; (d) determining an initial pressure reduction of the subterranean reservoir, wherein the initial pressure is determined by a gas hydrate stability zone of a pure methane hydrate, wherein the initial pressure is greater than a stability value; (e) reducing the pressure within the subterranean reservoir, wherein the pressure is incrementally reduced; (f) obtaining a series of pressure measurements within the subterranean reservoir, wherein the series of pressure measurements is indicative of at least one characteristic of the subterranean reservoir; and (g) stabilizing the pressure within the subterranean reservoir, wherein steps (e)-(g) are repeated.

In a further embodiment, a system for determining hydrate composition including: (a) a subterranean reservoir, wherein the subterranean reservoir is a hydrate bearing subterranean reservoir; (b) a pressure reduction means for incrementally reducing the pressure within the subterranean reservoir; (c) a formation testing tool, wherein the formation testing tool is installed within the subterranean reservoir, wherein the formation testing tool is capable of evaluating the composition of released fluids and gases from the subterranean reservoir, wherein the formation testing tool is capable of evaluating the composition of liquids and gases within the subterranean reservoir; (d) a means for introducing a releasing agent into the subterranean reservoir; and (e) a means for recovering hydrocarbons from the subterranean reservoir.

DETAILED DESCRIPTION OF THE INVENTION

It is to be appreciated that this invention is not limited in its application to the details of construction and the arrangement of components set forth in the following description or illustrated in the drawings. The invention is capable of other embodiments and of being practiced or of being carried out in various ways, and the invention is not limited to the examples presented unless specifically recited in the claims. In addition, it is to be appreciated that the phraseology and terminology used herein is for the purpose of description and should not be regarded as limiting. The use of the words "including," "comprising," "having," "containing," or "involving," and variations thereof herein, is meant to encompass the items listed thereafter and equivalents thereof as well as additional items.

From an economic standpoint, it may be of primary importance to distinguish gas hydrate deposits that have productive potential from those that do not. Liberating gas from hydrate requires temperature increase, pressure reduction, or inhibitor use. To develop less ambiguous exploration methods, it may be important to understand the mechanisms by which gas hydrate deposits are formed. Given appropriate temperature and pressure conditions, gas availability may be a primary factor controlling the quantity and distribution of hydrate deposits, and the nature of a deposit may depend on how gas is delivered to the site of hydrate production. Gas may be provided to the gas hydrate stability zone in one of three ways, namely by local production of the gas in the gas hydrate stability zone, migration of gas through pore spaces in the sediment into the gas hydrate stability zone, and migration of gas through faults or fractures into the gas hydrate stability zone.

The hydrate P-T stability envelope for a given gas component is a specific range of pressure and temperature values defining an area on a P-T plot within which the formation of a stable gas hydrate for the given gas component occurs. The boundary limit of this area on the P-T plot is typically defined by a distinct curve. As such, the hydrate P-T stability envelope for the given gas component is established at higher temperatures and pressures than indicated by the curve. It is noted that when the curves defining the boundary limits of the hydrate P-T stability envelopes for two or more distinct pure components are plotted on a single multi-component hydrate stability graph, portions of the various pure component hydrate P-T stability envelopes may partially overlap or may lie entirely within the hydrate stability envelope of another component.

Hydrate production is often dependent on understanding the composition of the actual hydrate contained in a subterranean reservoir. As used herein, a subterranean reservoir may include porous rock or sediments associated with the proper pressure and temperature conditions necessary to form natural gas hydrates.

In order to determine one or more characteristics of a subterranean reservoir, one or more wells are drilled into the subterranean reservoir and into a hydrate-bearing formation. In an embodiment, the subterranean reservoir may be an open hole, i.e., a hole without a casing string. In another embodiment, the subterranean reservoir may be a cased hole, i.e., a hole containing a casing string. If a casing string is used, then the casing string should include windows or perforations opening directly to the hydrate-bearing formation. Furthermore, one or more characteristics within the subterranean reservoir may be determined at single point or at an interval. If it is determined that one or more characteristics of the subterranean reservoir should be determined at a single point, then a probe or the like may need to be attached to the formation testing tool. On the other hand, if it is determined that one or more characteristics of the subterranean formation should be determined at an interval, then the interval in question should be isolated from the rest of the well bore. In an embodiment, a packer assembly may be utilized in the well bore to isolate the interval from the rest of the subterranean reservoir. The thickness of the interval is determined in part by the specifications of a formation testing tool, including the location of the packers and the volume of fluids the formation testing tool can hold. In an embodiment, the interval thickness is between about 1 to about 10 meters. However, the interval can be smaller or larger than the given range based on the specific interval. After the point or interval is identified, a formation testing tool is inserted into the subterranean reservoir. As used herein, a formation testing tool may be utilized for gathering subterranean reservoir data and for controlling changes in the fluid pressures in the well adjacent to the subterranean reservoir. In an embodiment, the formation testing tool is capable of gathering subterranean reservoir data for determining one or more characteristics of the subterranean reservoir. In another embodiment, the formation testing tool is capable of controlling the pressure around the tool, including drawing down the ambient reservoir pressure to lesser values. In another embodiment, the formation testing tool is capable of evaluating the composition of released fluids and gases from the subterranean reservoir.

Once the formation testing tool is located in the well bore adjacent to the subterranean formation of interest, the formation testing tool is allowed to equilibrate with the fluid pressures of the subterranean reservoir. To determine one or more characteristics within a subterranean reservoir, including the composition of the hydrates within the subterranean reservoir, the pressure within a subterranean reservoir is incrementally reduced. Induced hydrate dissociation during an incremental pressure reduction is used to indicate the hydrate stability P-T boundary for a hydrate of a given composition. When the pressure drops below the stability value of the hydrate composition, the hydrates dissociate and release gas and free water. The amount of hydrate dissociation at a given pressure condition indicates the volume occupied in the pore space by a hydrate of a particular composition. In one embodiment, the testing occurs on a subterranean reservoir to determine in-place composition of naturally-formed hydrate. In another embodiment, the testing can occur following a releasing agent being injected into the formation reservoir. The releasing agent contacts the gas hydrate, resulting in the releasing agent spontaneously (i.e., without the need for added energy) replacing the gas within the hydrate formation without requiring a significant change in the temperature, pressure, or volume of the hydrate. As the hydrate becomes enriched in the releasing agent as it displaces the original gas molecules in the hydrate structure, the hydrate releasing agent mixture that surrounds the hydrate in the subterranean formation pore volume becomes more stable based on the thermodynamic pressure-temperature relationship. As used herein, the releasing agent may be a compound that forms a more thermodynamically stable hydrate structure than the gas originally contained within the hydrate structure. The releasing agent is selected from a group consisting of carbon dioxide, ethane, xenon, hydrogen sulfide, and mixtures thereof. In an embodiment, the releasing agent is liquid. In another embodiment, the releasing agent is liquid carbon dioxide.

After an initial period of releasing agent exchange, the pressure of the well can be reduced and a series of pressure reduction steps can be used to determine the composition of the stable hydrate. In an embodiment, the pressure is incrementally reduced. In an embodiment, the pressure is incrementally reduced between about 1 psi to about 20 psi. In another embodiment, the pressure is incrementally reduced between about 5 psi to about 15 psi. In yet another embodiment, the pressure is incrementally reduced by about 10 psi. A series of pressure measurements is obtained, which are indicative of at least one characteristic of the subterranean reservoir.

Further enhancements for testing would include measurement of released fluid (water, gas, liquid) from the dissociated hydrate during the incremental pressure decrease. Measurements could include but not limited to composition of the gas or liquid released upon hydrate dissociation including using measurement techniques such as Raman spectroscopy.

The preferred embodiment of the present invention has been disclosed and illustrated. However, the invention is intended to be as broad as defined in the claims below. Those skilled in the art may be able to study the preferred embodiments and identify other ways to practice the invention that are not exactly as described in the present invention. It is the intent of the inventors that variations and equivalents of the invention are within the scope of the claims below and the description, abstract and drawings not to be used to limit the scope of the invention.

The invention claimed is:

1. An in-situ method for determining composition of a hydrate in a subterranean reservoir, the method comprising:

a. introducing a formation testing tool into the subterranean formation, wherein the formation testing tool controls pressure around the tool and detects presence of fluids;

b. determining an initial fluid pressure at a point or interval within the subterranean reservoir, wherein the hydrate is stable;

c. incrementally reducing the pressure at the point or interval within the subterranean reservoir until the reduction in pressure leads to dissociation of the hydrate composition;

d. determining the pressure and temperature of the dissociation; and e. determining the composition of the hydrate based on pressure temperature stability curves of hydrates.

2. The method according to claim 1, wherein step (a) further includes injecting a releasing agent into the subterranean reservoir and wherein the releasing agent is liquid.

3. The method according to claim 1, wherein step (a) further includes injection a releasing agent into the subterranean reservoir and wherein the releasing agent is selected from a group consisting of group consisting of carbon dioxide, ethane, xenon, hydrogen sulfide, and mixtures thereof.

4. The method according to claim 3, wherein the releasing agent is carbon dioxide.

5. The method according to claim 1, wherein the pressure is incrementally reduced by about 1 psi to about 20 psi.

6. The method according to claim 5, wherein the pressure is incrementally reduced by about 5 psi to about 15 psi.

7. The method according to claim 1, wherein the initial pressure reduction is determined by utilizing the P-T stability envelope.

8. The method according to claim 7, wherein the initial pressure reduction is a gas hydrate stability zone of a pure methane hydrate.

9. The method according to claim 7, wherein the initial pressure reduction is greater than a stability value.

* * * * *